United States Patent [19]
Smith
[11] 4,318,257
[45] Mar. 9, 1982

[54] BUILDING ASSEMBLY WITH IMPROVED INSULATION CHARACTERISTICS

[76] Inventor: Robert L. Smith, 2026 Emery Wood Dr., Charlotte, N.C. 28210

[21] Appl. No.: 128,568

[22] Filed: Mar. 10, 1980

[51] Int. Cl.³ ..... E04B 1/10
[52] U.S. Cl. ..... 52/233; 52/351; 52/404
[58] Field of Search ..... 52/233, 290, 351, 354, 52/404, 410, 512

[56] References Cited

U.S. PATENT DOCUMENTS

| | | | |
|---|---|---|---|
| 2,130,231 | 9/1938 | Forciea | 52/233 |
| 2,309,420 | 1/1943 | Taylor | 52/351 |
| 3,460,301 | 8/1969 | Davis | 52/233 |
| 3,992,838 | 11/1976 | Vizziello | 52/233 |
| 3,998,017 | 12/1976 | Whitlock | 52/233 |
| 4,185,428 | 1/1980 | Boucquey et al. | 52/233 |

FOREIGN PATENT DOCUMENTS

| | | | |
|---|---|---|---|
| 42124 | 11/1925 | Norway | 52/233 |

*Primary Examiner*—Price C. Faw, Jr.
*Assistant Examiner*—Carl D. Friedman
*Attorney, Agent, or Firm*—David M. Carter

[57] ABSTRACT

There is provided a building structure made from wooden logs with gaps between the logs for receiving insulation. The gaps are formed between the stacked logs by driving sharpened spikes into oppositely facing logs so that the opposing sharpened tips of the spikes penetrate the logs and secure a fixed distance between such logs. Two spikes are normally aligned with one another and respectively driven near the inner and outer walls of the log structure. Each spike has a hole drilled there through for receiving a screw-like rod interconnecting the two spikes and supporting various building items such as a wire mesh screen for receiving plaster, a vapor barrier and inside panels. Furthermore, insulation is provided between the two logs so that the thermal resistance of the overall building structure is greater than a building structure which would use logs alone.

15 Claims, 10 Drawing Figures

BUILDING ASSEMBLY WITH IMPROVED INSULATION CHARACTERISTICS

BACKGROUND OF THE INVENTION

This invention relates to a building assembly with improved thermal insulation characteristics. More particularly, it relates to a log building structure which utilizes opposing spikes or splines for providing an air space for receiving thermal insulation, as well as providing a convenient mechanism for attaching various building items such as wire mesh screens for receiving plaster, vapor barriers and building panels. Because of their natural appeal, log homes and other log building structures have been growing in popularity recently. These log homes utilize wooden logs for both a round and square structure. While wood is a much better insulator than a lot of building materials, such as for example brick and concrete, it has been found that log homes are quite often difficult to properly insulate. For example, an 8" across square pine log has an R value of approximately R-9. R value is the resistance to thermal conductivity of a particular material. Because of the current energy crisis, many utilities give customers rate reductions if their homes and establishments have an overall R value of R-16 and above. Thus it can be seen that uninsulated log homes would not qualify for rate reductions. Various attempts have been made in the past to insulate log homes. An example of an attempt to prevent invection from seeping in and out of a log structure is disclosed in U.S. Pat. No. 3,460,301 to Davis. The Davis patent uses elongated metal sheets to trap a resilient packing material between adjacent logs and a log wall and further to provide a flexible joint there between. It appears that the Davis patent would not have any significant effect of the R value of the log cabin, but it would tend to prevent drafts from seeping between the logs.

U.S. Pat. No. 2,130,231 issued to Forciea shows a log cabin structure with slots in adjoining logs and appropriate elongated ceiling members in adjacent slots. A material such as okum is provided between the logs, again to prevent air drafts from coming into the cabin.

U.S. Pat. No. 3,992,838 issued to Vizziello shows a log with slots therein for receiving insulation in the slots themselves. While this insulation will retard some heat flow, it is believed that this structure will not bring the R value up to R-16, as required by the utilities.

U.S. Pat. No. 3,908,322 issued to Shoaf shows a log structure utilizing strips of urethane insulation there between. Each log includes a groove which is adapted to receive a splide for holding the logs together.

U.S. Pat. Nos. 3,511,000, 3,665,664, 3,295,286 and 3,106,751 all show wall insulation systems which provide mechanisms for mounting panels thereto.

OBJECT OF THE INVENTION

It is therefore one object of this invention to provide a building assembly which utilizes logs and has improved thermal insulation characteristics.

Another object is to provide a log building structure which has a means to provide insulation spacing between the logs, such means also providing a handy mechanism for attaching various building items to the structure.

It is still another object of this invention to provide a log building structure which meets energy efficient requirements, yet is easy to assemble and pleasing in appearance.

SUMMARY OF THE INVENTION

In accordance with one form of this invention there is provided a building assembly including parallel adjacent logs at least one pair of spacers are secured between log sections, one spacer being towards the outer wall of the building and another spacer being towards the inner wall of the building. These spacers may be spikes. Each spacer is aligned with its adjacent spacer and provides a space between logs so that insulation may be inserted between such logs, such insulation having a greater resistance to thermal conductivity than the logs themselves so that the overall R value of the building is increased over the use of logs only with no insulation. The adjacent spacers may include at least one hole there through so that the adjacent spacers are connected together by a rod. A rod is adapted to hold a mesh screen for receiving mortar on the outer surface of the log structure and for holding panel board on the inner surface of the log structure.

BRIEF DESCRIPTION OF THE DRAWINGS

The subject matter which is regarded as the invention is set forth is set forth in the appended claims. The invention itself, however, together with further objects and advantages thereof may be better understood by referring to the following description taken in conjunction with the accompanying drawings in which:

DESCRIPTION OF THE PREFERRED EMBODIMENT

Figure 1:
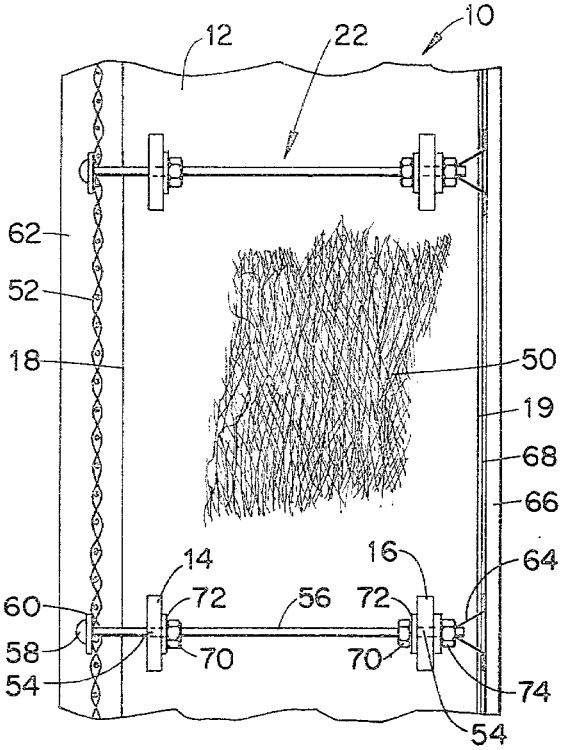
FIG. 1 is a top view of the building assembly of the present invention with the top log removed.

Referring now more particularly to FIG. 1, there is provided log building assembly 10, including a lower log 12. Its facing upper log has been removed so that the assembly may be readily seen. Spikes 14 and 16 are driven into the opposite faces of log 12, as well as the log on top which is not shown. Spike 14 is near the outside edge 18 of the log home, while spike 16 is near the inside edge 20 which faces the inside of the log home. Spikes 14 and 16 are substantially aligned with one another. Other spike assemblies, such as assembly 22, occur about every 12 inches along the length of the logs.

Figure 2:
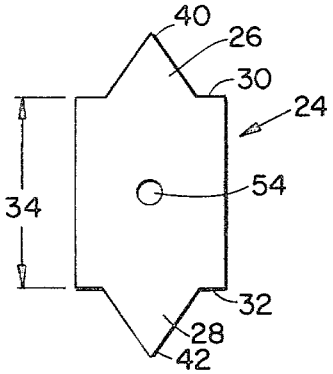
FIG. 2 is a side view of one version of a spike which may be used in accordance with this present invention.
Figure 5:
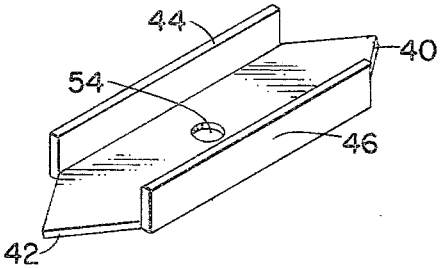
FIG. 5 is an isometric view of the spike of FIG. 2 with the stops bent inwardly 90°.
Figure 8:
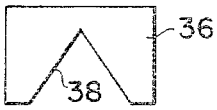
FIG. 8 is a side view of a special device used to protect the sharpened surfaces of the spikes of FIGS. 2 through 5 so they may be readily driven into the logs by hammer.

One type of spike which may be used in the embodiment of FIG. 1 is shown in FIG. 2. As can be seen, spike 24 includes upper portion 26 and lower portion 28, each having sharpened points which are designed to penetrate into respectively upper and lower logs to the point of stop shoulders 30 and 32, which are on either side of the points. Thus a gap of approximately the distance shown by 34 is provided between the logs and which may be filled with an insulation, such as fiberglass insulation. In one embodiment of this invention the gap 34 was 4". Spike 24 should be made of a metal such as steel which is easily driven into pine log by use of a hammer and a cover plate 36 as shown in FIG. 8. The notch 38 fits over the top of spike 24 and interfaces with point 40 so that point 42 may be easily driven into the log. Once point 42 has been driven into the log up to stop 32, the upper log is then placed on top of point 40 and one hammers on the top of the upper log until the point 40 is driven into the upper log up to stop 30. The spike 24 shown in FIG. 2 shows stops 30 and 32 consisting of flanges which extend outwardly from and in the same plane of the remainder of the spike. In another embodiment shown in FIG. 5, flanges 44 and 46 have been bent inwardly 90° with respect to the remaining plane of the spike.

Figure 6:
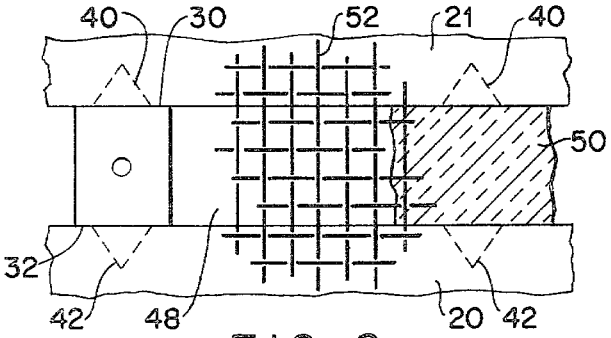
FIG. 6 is a side view of the building assembly of FIG. 1 with the wall panel removed showing a portion of the wire mesh screen and a portion of the insulation.
Figure 7:
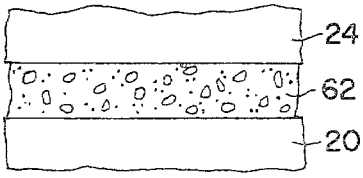
FIG. 7 is a side view of the portion of the outside of the building structure showing mortar between the logs.

Referring to FIG. 6 one can readily see that points 40 and 42 are driven into oppositely facing logs 20 and 21 with stops 30 and 32 abutting against the upper and lower surfaces of the logs. Thus an air space 48 is provided between the logs 20 and 21. This air space, as stated before, is provided so that insulation 50 which is shown in partial in FIG. 6 may be applied between the logs. Insulation may be of various types such as foam, urethane or fiberglass. The screen 52 will be explained further in reference to FIG. 1. As can be seen, aligned spikes 14 and 16 have holes 54 drilled there through for receiving a long screw or rod 56. This rod 56 together with the mounted spikes secures various building items to the sides of the log structure. For example, screen 52 is supported to the outer side 18 of the logs by means of screw head 58 and bushing 60. As can be seen, the screw goes right through the screen. This screen is utilized to hold mortar 62 to the sides of the logs. The mortar between the logs 20 and 21 are better seen in reference to FIG. 7, which shows a portion of the outside of the log structure. Furthermore, the opposite side of screw 56 holds panel clip 64 which secures a decorative wooden panel 66 to the inside of the log structure. Panel clip 64 is a well known panel clip. Furthermore, this panel clip also secures vapor barrier 68 in contact with insulation 50. Rod 56 further provides stability to the spike in that it mechanically connects the two together. The screw 56 is kept from sliding about in that it is coupled to the spikes by means of nuts 70 and washers 72. Nut 74 holds the panel clip to the rod. Of course, corresponding assembly 22 is identical to the upper described rod and spike assembly.

Figure 3:
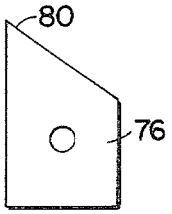
FIG. 3 is a side view of one half of a spike which may be used alternatively to the spike of FIG. 2.
Figure 4:
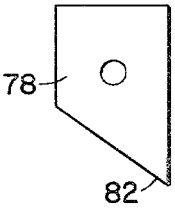
FIG. 4 is the other half of the spike of FIG. 3.
Figure 9:
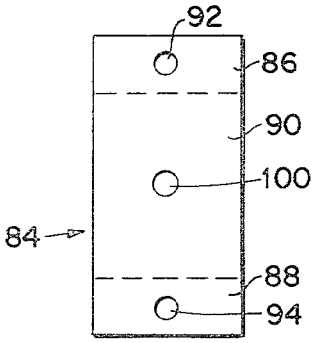
FIG. 9 is a side view of an alternative spacer to that of FIG. 2 showing that the ends have not yet been bent down.
Figure 10:
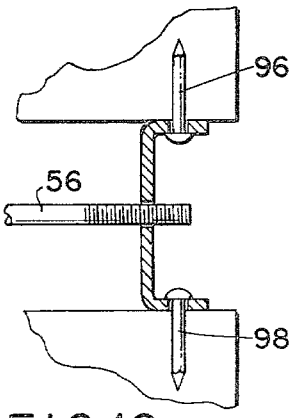
FIG. 10 is a partial side view of an alternative building assembly to that of FIG. 6 wherein the spacer of FIG. 9 is used.

Thus it can be seen that this rod and spike assembly provides many functions, such as providing insulation space, holding the mortar screen to the outside of the log structure, holding decorative panel and vapor barrier to the inside of the structure. Furthermore, the panel and the mortar cooperate with the tops and the bottoms of the logs to hold the insulation in place. Other types of spikes and spacers may be used in lieu of the spikes shown in FIGS. 2 and 5 without departing from the spirit and scope of this invention. For example, FIGS. 3 and 4 show two half spikes 76 and 78 which may be screwed together in place of integral spike 24 so that the sharp tip 80 pierces the top log 21 and the sharp tip 82 pierces the bottom log 20. Thus the combination of the spikes shown in FIGS. 3 and 4 provides a non-integral version of the spike 24. An alternative spacer to the other described spike is shown in FIG. 9 which shows spacer 84 having top portion 86 and bottom portion 88 adapted to be bent at approximately 90° with respect to the middle section 90 of this spacer. Holes 92 and 94 are adapted to receive nails 96 and 98 as shown in FIG. 10, such nails being driven into the upper and lower logs in lieu of the tips 40 and 42 of the integral spikes. FIG. 10 does not show all the features of FIGS. 1 and 2 but the spacer could be adapted to be used in lieu of spike 24. As can be seen, rod 56 also goes through a hole 100 in spacer 84. Furthermore, it can be seen that these spacers and spikes provide a space for the tongue of an intersecting right angle log at the corner of the building.

From the foregoing description of the exemplification embodiment of the invention, it will be apparent that many modifications may be made therein. It will be understood therefore that this embodiment is intended as an exemplification of the invention only and that the invention is not limited thereto. It is to be understood therefore that it is intended in the appended claims to cover all such modifications as fall within the true spirit and scope of the invention.

What is claimed is:

1. A building assembly comprising:

at least one pair of oppositely facing logs;

said logs being kept at a predetermined distance from one another by a pair of aligned spikes, said spikes being aligned with one another across the width of said logs, each spike including a pair of sharp tips on opposite ends;

said sharp tips being firmly received in said logs;

the predetermined distance between said logs forming an air space;

said air space receiving insulation having an R value greater than the R value of the logs whereby the overall R value of the building assembly is increased over that of a building of such logs only;

each spike including a hole there through, said holes receiving a rod mechanically connecting said aligned spikes together, said rod supporting at least one building material.

2. The assembly as set forth in claim 1 wherein said aligned spikes are bolted together.

3. The assembly as set forth in claim 1 wherein each of said spikes is an integral piece.

4. The assembly as set forth in claim 1 further including a screen mesh mounted on the outside of said assembly and being secured to the outside of said assembly by said rod, said screen mesh adapted to support mortar which is applied between said logs on the outside of said assembly.

5. The assembly as set forth in claim 1 further including a panel mounted on the inside of said assembly and adjacent the inner surfaces of the logs, means connected to said rod and said panel for securing said panel to said assembly.

6. The assembly as set forth in claim 1 further including a vapor barrier adjacent to the insulation, said vapor barrier being supported by said rod.

7. The assembly as set forth in claim 1 further including a cap means adapted to cover one of the pointed ends of said spike for readily driving the other end of said spike into a log.

8. The building assembly as set forth in claim 1 further including stop means on said spikes for providing a fixed distance between said logs so that the amount of insulation there between may remain relatively constant for various lengths along the logs.

9. A building assembly including at least a top and a bottom log and at least a pair of spacers secured between said logs for providing an air space receiving insulation having a greater R value than the logs themselves whereby the overall R value of the building assembly is increased over the use of logs alone, said paired spacers being aligned with one another across the width of said logs, each of said spacers including a hole drilled there through for receiving a rod, said rod mechanically coupling a pair of spacers together, said rod supporting at least one building material.

10. A building assembly as set forth in claim 9 wherein said spacers are substantially C-shaped and secured to the inside surfaces of said logs by means of nails.

11. The assembly as set forth in claim 9 wherein said spacers are spikes having sharp tips at their opposite ends, said tips being driven into said logs for securing the space distance necessary for receiving the insulation.

12. The assembly as set forth in claim 9 further including a screen mesh for holding mortar to the outside of said assembly, a portion of said rod including a screw head coupled to said screen for holding said screen to said assembly.

13. The assembly as set forth in claim 9 further including a panel mounted on the inside of said assembly, means for securing said panel to said rod.

14. The assembly as set forth in claim 9 further including a vapor barrier adjacent to said insulation, means for securing said vapor barrier to said rod.

15. A building assembly comprising:

a pair of multi-purpose subassemblies each including first and second spikes opposite one another and being driven in a pair of logs facing each other;

said spikes each including a pair of sharp tips on opposing ends;

said spikes being aligned with one another across the width of said logs;

stop means adjacent said sharp tips for preventing too deep a penetration by said sharp tips into said logs, thereby providing a predetermined volume of air space between said logs, said air space being substantially filled with thermal insulation;

each spike having a hole there through for receiving a rod;

a wire mesh screen coupled to said rod and being secured to the outer face of the building assembly by said rod, said screen adapted to secure mortar to a portion of the outer part of said assembly;

a vapor barrier and an interior panel, said vapor barrier and interior panel being secured to said rod by a panel clip, said panel clip secured to one end of said rod.

* * * * *